US009964077B2

(12) United States Patent
Neal et al.

(10) Patent No.: US 9,964,077 B2
(45) **Date of Patent: *May 8, 2018**

(54) HELICAL TUBE EGR COOLER

(71) Applicants: Kennieth Neal, Mesa, AZ (US); Eugene Neal, Mesa, AZ (US)

(72) Inventors: Kennieth Neal, Mesa, AZ (US); Eugene Neal, Phoenix, AZ (US); Eric Wilderson, Medford, OR (US); James Cunningham, Mesa, AZ (US)

(73) Assignees: Kennieth Neal, Mesa, AZ (US); Eugene Neal, Phoenix, AZ (US)

( * ) Notice: Subject to any disclaimer, the term of this patent is extended or adjusted under 35 U.S.C. 154(b) by 0 days. days.

This patent is subject to a terminal disclaimer.

(21) Appl. No.: 15/434,787

(22) Filed: Feb. 16, 2017

(65) Prior Publication Data

US 2017/0175684 A1 Jun. 22, 2017

Related U.S. Application Data

(63) Continuation-in-part of application No. 13/864,018, filed on Apr. 16, 2013, now Pat. No. 9,605,912.

(51) Int. Cl.

| | |
|---|---|
| ***F02M 26/32*** | (2016.01) |
| ***F01P 3/20*** | (2006.01) |
| ***F28D 7/02*** | (2006.01) |
| ***F28D 7/16*** | (2006.01) |

(52) U.S. Cl.

CPC ..... *F02M 26/32* (2016.02); *F01P 3/20* (2013.01); *F28D 7/024* (2013.01); *F28D 7/1607* (2013.01); *F28D 7/026* (2013.01)

(58) Field of Classification Search

CPC ..... F28D 7/024; F28D 7/026; F28D 7/1607; F02M 26/32; F01P 3/20

USPC ..... 165/157, 158, 163

See application file for complete search history.

(56) References Cited

U.S. PATENT DOCUMENTS

| | | | |
|---|---|---|---|
| 1,655,086 | A | 1/1928 | Blanding |
| 2,693,346 | A | 11/1954 | Petersen |
| 5,213,156 | A | 5/1993 | Eriksson |
| 5,551,504 | A | 9/1996 | Lifferer |
| 6,460,520 | B1 | 10/2002 | Challis |
| 7,213,639 | B2 | 5/2007 | Danielsson et al. |
| 8,042,608 | B2 | 10/2011 | Baker |
| 8,079,409 | B2 | 12/2011 | Ishimori et al. |
| 8,251,133 | B2 | 8/2012 | VanDecker et al. |

FOREIGN PATENT DOCUMENTS

| | | |
|---|---|---|
| DE | 10 2005 058314 A1 | 6/2007 |
| EP | 1 770 343 A1 | 4/2007 |
| WO | 2011/008921 A2 | 1/2011 |

*Primary Examiner* — Jianying Atkisson
*Assistant Examiner* — Joel Attey

(57) ABSTRACT

A heat exchanger for transferring heat between two fluids consists of a shell surrounding at least two tube bundles attached at both ends to a tube header. Each of the tube bundles is constructed from a plurality of individual tubes that are twisted into identical helixes formed about a common helical axis. Because each individual tube is formed in the shape of a helix, rather than as a straight tube, thermal elongation of the individual tubes results in a considerably reduced axial force on the tube attachments and tube header. Use of multiple tube bundles wound with opposite twist direction improves spacing efficiency between tubes.

9 Claims, 4 Drawing Sheets

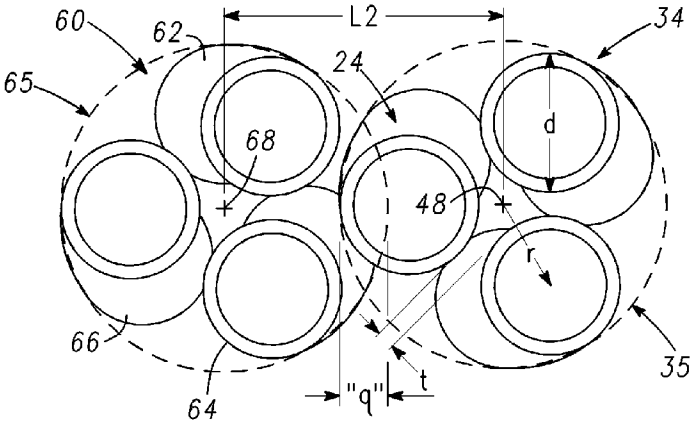
Fig. 4
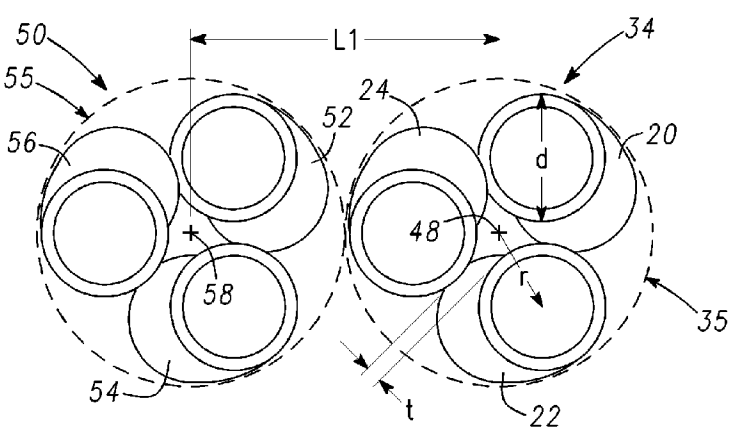
Fig. 3 -PRIOR ART-
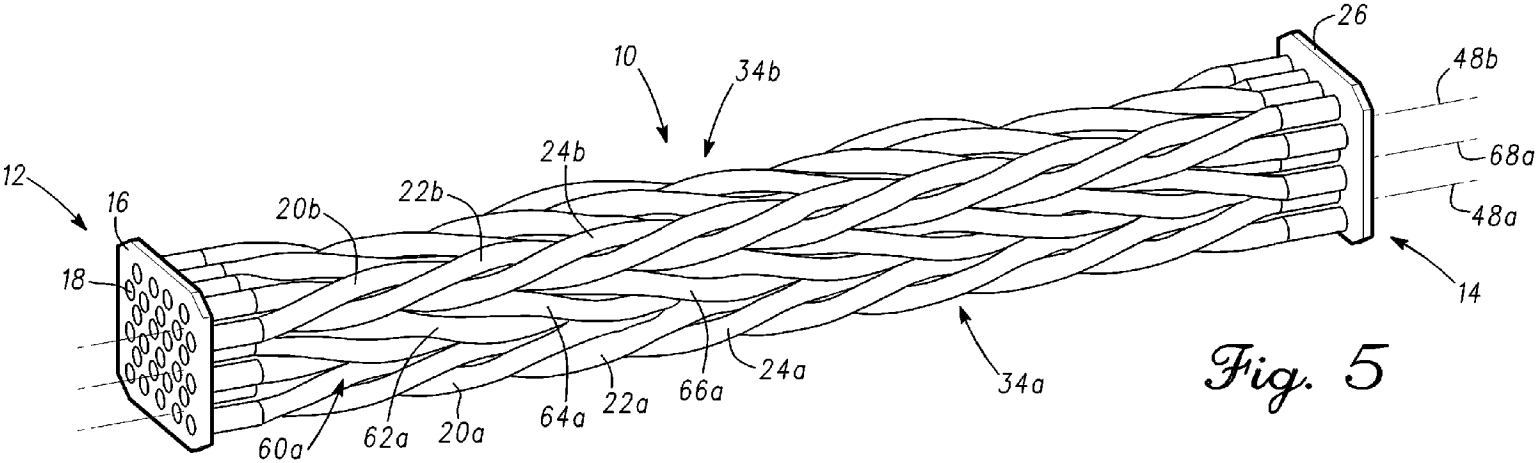
Fig. 5

HELICAL TUBE EGR COOLER

BACKGROUND OF THE INVENTION

This invention relates to internal combustion engines and, in particular, to methods and apparatus for reducing exhaust emissions.

It is well known in the art to use exhaust gas recirculation (EGR) as a means of controlling the emissions of nitrous oxides (NOx) from internal combustion engines. In a typical EGR system, a portion of the exhaust gases (typically from 5 to 15%) is reintroduced into the induction system along with the fresh charge of air and fuel. The exhaust gas, which is essentially inert, displaces the amount of combustible mixture in a gasoline (Otto cycle) engine. In a diesel engine, the exhaust gas replaces some of the excess oxygen in the pre-combustion mixture. Because NOx forms primarily when a mixture of nitrogen and oxygen is subjected to high temperature, the lower combustion temperatures caused by the reduction in combustible mixture or excess oxygen reduces the amount of NOx the combustion produces.

In 2002, United States environmental protection agency implemented regulations that required exhaust gas recirculation coolers to be implemented in passenger vehicles and light trucks equipped with diesel engines as a means of further reducing the NOx emissions from these vehicles. Such exhaust gas recirculation coolers are typically of the gas-to-liquid heat exchanger variety and are most often of a shell-and-tube heat exchanger design in which the exhaust gas passes through a plurality of tubes encased in a shell through which the engine coolant circulates. U.S. Pat. No. 8,079,409 and U.S. Pat. No. 7,213,639 are typical of such exhaust gas recirculation cooler designs Difficulties associated with exhaust gas recirculation coolers in diesel engines include the fact that reducing the combustion temperature increases the amount of soot formed by the combustion process. This soot tends to deposit in the tubes of the exhaust gas recirculation cooler where it acts as an insulating layer that reduces the thermal efficiency of the exhaust gas recirculation cooler. Additionally, if the engine coolant runs low, the heat exchanger may be starved of coolant and may experience a so-called "thermal event" in which the cooler tubes, heated nearly to the temperature of the exhaust gas, thermally expand to a degree that exceeds the structural integrity of the heat exchanger.

Various methods have been suggested to improve the longevity of exhaust gas recirculation coolers, including use of expansion joints, forming the tubes in the shape of elongated bellows and/or manufacturing the exhaust gas recirculation cooler as a series of short modules, each of which has a relatively small overall thermal growth. For example, U.S. Pat. No. 6,460,520 issued to Challis, suggests construction of an EGR cooler in which the shell portion includes a plurality of 90 degree bends formed as corrugated bellows. According to Challis, the bellows sections have increased compliance over a straight-walled shell and, therefore, the bellows provide for better accommodation of thermal expansion or other movements. U.S. Pat. No. 7,213,639 issued to Danielsson et al. suggests an EGR cooler in which the flow of the exhaust gas enters through a central row of tubes and exits through a peripheral row of tubes. According to Danielsson, the reversing flow reduces the risk of local hot spots due to stagnation of coolant flow. German Patent DE 10 2005 058314 A1 (Daimler Chrysler AG) discloses an EGR cooler in which three tubes are formed into tube bundles that are twisted into helixes formed about a common helical axis. The tubes, however, are all wound with the same direction of twist (i.e. all right-hand or all left-hand twist) and are wound about an imaginary rod having a non-zero diameter. Because the tube bundles all have the same direction of twist, it is not possible to position the tube bundles any closer together than an equivalent group of cylinders having the same outside diameter as the tube bundles. Winding the tubes about a central rod having a non-zero diameter, leads to additional spacing inefficiency.

SUMMARY OF THE INVENTION

The present invention comprises a heat exchanger for transferring heat between two fluids, for example between a hot exhaust gas and a liquid coolant. In one embodiment, the heat exchanger comprises a shell surrounding at least two tube bundles attached at both ends to a tube header. Each of the tube bundles is constructed from a plurality of individual tubes that are twisted into identical helixes formed about a common helical axis. Because each individual tube is formed in the shape of a helix, rather than as a straight tube, the individual tubes behave in a manner similar to a spring, rather than a column. Consequently, thermal elongation of the individual tubes is resolved primarily as an increase in the helical diameter of the tubes rather than an elongated column. This results in a considerably reduced axial force on the tube attachments and tube header. Moreover, since each tube is free to expand or contract with temperature, a single tube that is subjected to a thermal event will expand to relieve its own thermal stress. Accordingly, a heat exchanger constructed in accordance with the teachings of the invention is more resistant to failures caused by a thermal event than prior art heat exchangers with moveable headers in which the entire header must move as a unit and which, therefore, cannot accommodate a single tube that is expanding at a greater rate than the adjacent tubes. Additionally, a heat exchanger constructed in accordance with the teachings of the invention inherently promotes more turbulent flow of the coolant passing over the tubes than a comparable straight-tube heat exchanger. Additionally, because the geometry of the tubes is not parallel to the coolant flow, use of helical tubes reduces or eliminates the necessity of installing baffles and therefore reduces or eliminates the problems associated with baffles causing formation of eddie currents in the coolant.

Preferably, the two tube bundles are formed with opposite helical twists, e.g., the first tube bundle has tubes wound in a helix having a right-hand helix and the second tube bundle has tubes wound in a left-hand helix. This enables the tube bundles to be positioned with their helical axes closer to each other than would be possible if all of the tube bundles had the same direction of twist. The heat exchanger may be formed of several tube bundles arranged in a rectangular array with each tube bundle having the opposite twist from each of the adjacent tube bundles. A rectangular array lends itself particularly well to applications in which installation space is limited.

BRIEF DESCRIPTION OF THE DRAWING

The present invention will be better understood from a reading of the following detailed description, taken in conjunction with the accompanying drawing figures in which like references designate like elements and, in which:

FIG. 3 is an end view of a Prior Art pair of tube bundles;

FIG. 4 is an end view of a pair of tube bundles for use in the heat exchanger of FIG. 1;

FIG. 5 is a perspective view of the heat exchanger of FIG. 1 with the shell removed for clarity;

DETAILED DESCRIPTION

Figure 1:
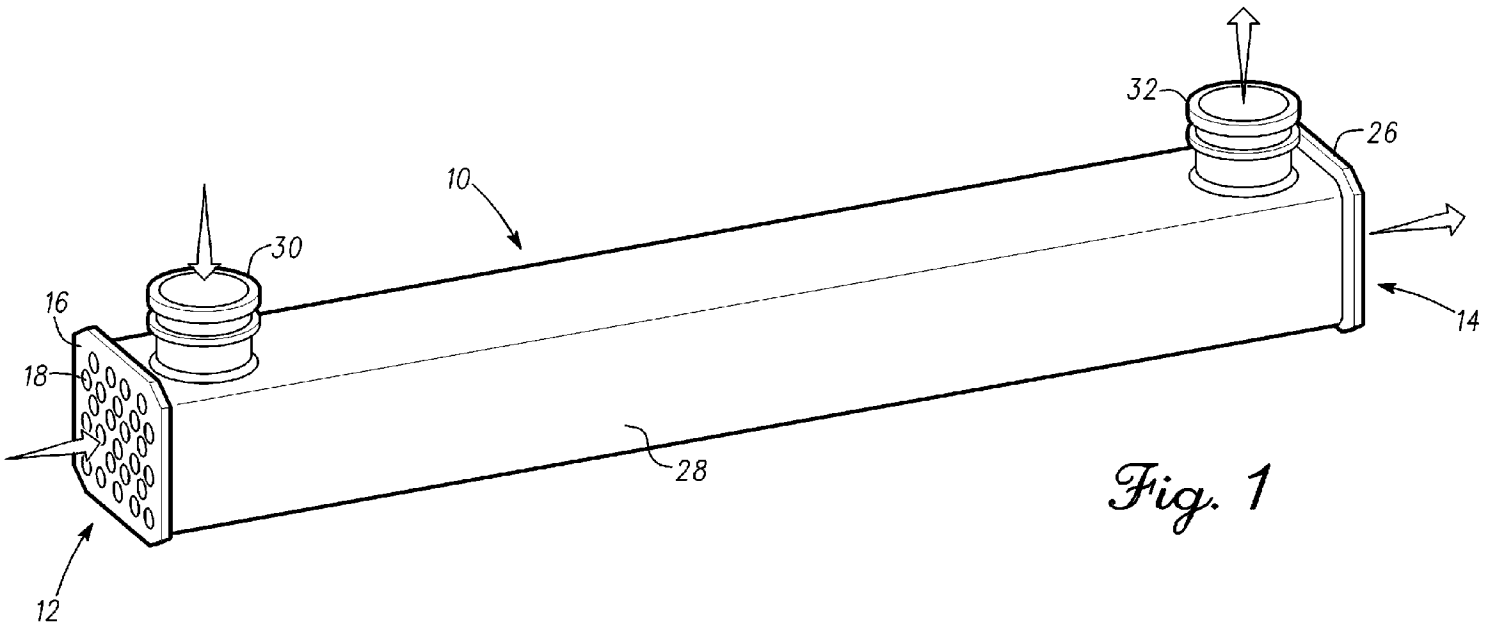
FIG. 1 is a perspective view of a heat exchanger incorporating features of the present invention.

The drawing figures are intended to illustrate the general manner of construction and are not necessarily to scale. In the detailed description and in the drawing figures, specific illustrative examples are shown and herein described in detail. It should be understood, however, that the drawing figures and detailed description are not intended to limit the invention to the particular form disclosed, but are merely illustrative and intended to teach one of ordinary skill how to make and/or use the invention claimed herein and for setting forth the best mode for carrying out the invention.

With reference to the figures and in particular FIG. 1, a heat exchanger 10 incorporating features of the present invention may be used as a heat exchanger for a variety of purposes in which it is desired to transfer heat from one fluid medium to another fluid. In one example, the heat exchanger may be used as an exhaust gas recirculation (EGR) cooler. A heat exchanger incorporating features of the present invention may, however, used in connection with any appropriate application to transfer heat from a fluid on one side of a barrier to a fluid on the other side of the barrier without bringing the fluids into contact. A heat exchanger incorporating the teachings of the present invention may be used with all types of fluids, for example air-to-air, air-to-liquid, liquid-to-liquid as appropriate to meet the particular needs of the application.

In the illustrative embodiment of FIG. 1, heat exchanger 10 comprises an EGR cooler having gas inlet end 12 and a gas outlet end 14 adapted to receive a flow of exhaust gas from a diesel engine. Gas inlet end 12 comprises a tube header consisting of a bulkhead 16 having a plurality of perforations 18. A plurality of hollow passageways such as tubes 20, 22 and 24 (FIG. 2) are mechanically coupled to bulkhead 16 in registry with perforations 18 (e.g. by welding, brazing or similar rigid attachment) to form a fluid-tight seal between the tubes and the bulkhead. Bulkhead 26 located at gas outlet end 14 is of identical construction and therefore will not be discussed in detail herein. Bulkhead 16 and bulkhead 26 are fluidically connected (e.g. by appropriate flanged connections and exhaust system pipes, not shown) to the diesel engine exhaust system.

A shell 28 extends between bulkhead 16 and bulkhead 26 and is mechanically coupled to bulkhead 16 and to bulkhead 26 (e.g. by welding, brazing or similar rigid attachment) to form a fluid-tight seal between the bulkheads and the shell. Shell 28 is provided with a coolant inlet passage 30 and a coolant outlet passage 32 to enable a flow of coolant to flow into shell 28 past the tubes contained within shell 28 and then out of shell 28 to an external radiator or other means of discharging the heat rejected from tubes 20-24. Although in the illustrative embodiment of FIG. 1 heat exchanger 10 comprises a parallel flow heat exchanger with coolant inlet passage 30 adjacent gas inlet end 12, the invention should not be considered as limited to the parallel flow heat exchanger embodiment. For example, a counter flow heat exchanger in which coolant inlet passage 30 is adjacent gas outlet end 14 is considered within the scope of the invention.

Figure 2:
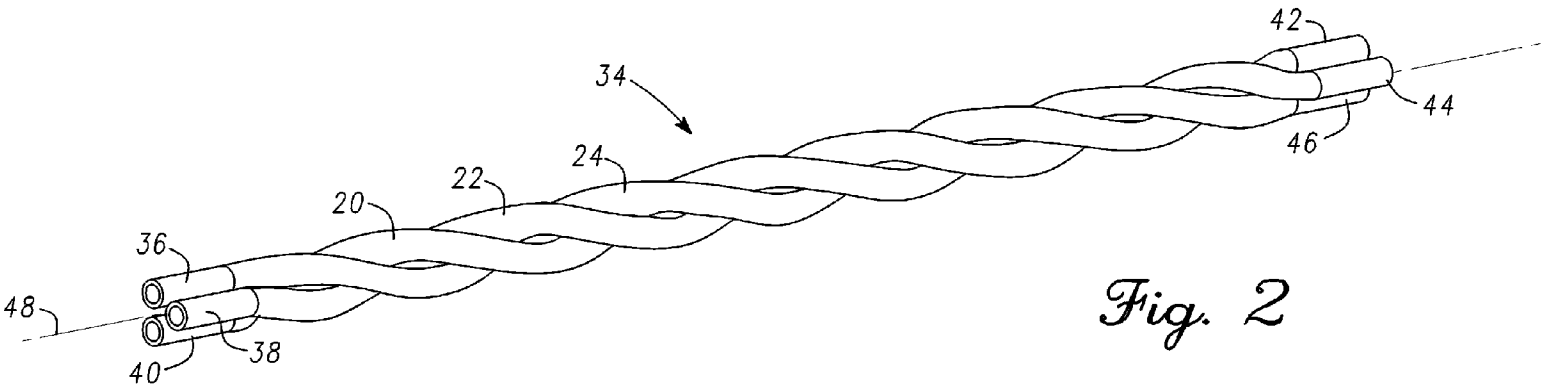
FIG. 2 is a perspective view of an individual tube bundle from the heat exchanger of FIG. 1.

With additional reference to FIG. 2, in the illustrative embodiment the tubes running between bulkhead 16 and bulkhead 26 are arranged into a plurality of tube bundles such as tube bundle 34. Each tube bundle 34 is composed of a plurality of individual tubes, e.g., three individual tubes 20, 22, 24. Each of the individual tubes has a relatively short straight section 36, 38, 40 at the gas inlet end 12 and a relatively short straight section 42, 44, 46 at gas outlet end 14. In between the relatively short straight sections, each of the three individual tubes 20, 22, 24 is wound into a helix, each of which has the same helical pitch, helical radius, and helical twist direction (e.g. right-hand or left-hand). All of the individual tubes 20, 22, 24 of tube bundle 34 share a common helical axis 48.

As discussed hereinbefore, because each individual tube 20, 22, 24 is formed in the shape of a helix, rather than as a straight tube, thermal elongation of the individual tubes is resolved primarily as an increase in helical diameter of the tubes rather than as a column elongation. This results in a considerably reduced axial force exerted by the tubes on bulkheads 16 and 26. For example, if a straight stainless steel 5/16 inch diameter tube having a length of 16.5 inches, a cross-sectional area of 0.01922 $in^2$ is subjected to a 400° F. temperature change, if unconstrained, the length of the stainless steel tube will increase by 0.0653 inches (400° F.×9.9 $E^{-6}$ in/in ° F.—the approximate thermal coefficient of expansion of stainless steel). If the tube is constrained by the bulkheads, the force exerted by the tube on the bulkheads is in excess of 2100 pounds.

If on the other hand the tube is twisted into a helix having a helical diameter of 0.461 inch and a helical pitch of 4.83 inches per revolution, then according to Hooke's law the force exerted by the tube on the bulkheads for the same 400° F. temperature change is reduced to slightly over 328 pounds, which is reduction is stress of more than 6:1. Because the helically wound tubes behave as coil springs, it should be observed that increasing the helical diameter and/or decreasing the helical pitch angle will cause a corresponding further reduction in the spring rate and, therefore, further reduce the stress on the bulkheads, while increasing the diameter and/or thickness of the tubes will cause a corresponding increase in the spring rate. Accordingly, variations in helical pitch, helical diameter, tube diameter, and tube thickness to accommodate the heat transfer, thermal expansion and other design constraints of a particular application are considered within the scope of the invention.

With additional reference to FIG. 3, tube bundle 34 is shown adjacent to a second tube bundle 50. Tube bundle 50, is composed of a plurality of individual tubes, e.g., three individual tubes 52, 54 and 56. Each of the individual tubes has a relatively short straight section (not shown) at the gas inlet end 12 and a relatively short straight section (not shown) at gas outlet end 14. In between the relatively short straight sections, each of the three individual tubes 52, 54 and 56 is wound into a helix, each of which has the same helical pitch, helical radius "r," and helical twist direction. All of the individual tubes 52, 54 and 56 of tube bundle 50 share a common helical axis 58. Helical axis 58 is parallel to helical axis 48 and offset radially by a distance L1. Because the individual tubes of tube bundle 50 have the same direction of twist, however, the distance L1 can be no less than a cylindrical radius 55 that is tangent to the outermost edges of the tubes forming tube bundle 50 plus a cylindrical radius 35 that is tangent to the outermost edges of the tubes forming the first tube bundle 34. This is because if it is attempted to bring the tube bundles closer together, the nearest tubes (e.g. tubes 24 and 52) will come into contact where the helixes cross. For tube bundles of exactly three tubes of equal diameter and equal helical radius, this spacing is defined by the formula:

$$L1 \geq \left[\left(\frac{2(t+d)}{\sqrt{3}}\right)+d\right]$$

where "t" is the spacing between tubes in the bundle and "d" is the outside diameter of the tubes in the bundle.

With additional reference to FIG. 4, tube bundle 34 is shown adjacent to a second tube bundle 60. Tube bundle 34 has a cylindrical radius 35 that is tangent to the outermost edges of the tubes forming the first tube bundle 34. Tube bundle 60, is composed of a plurality of individual tubes, e.g., three individual tubes 62, 64 and 66. Each of the individual tubes has a relatively short straight section (not shown) at the gas inlet end 12 and a relatively short straight section (not shown) at gas outlet end 14. In between the relatively short straight sections, each of the three individual tubes 62, 64 and 66 is wound into a helix, each of which has the same helical pitch, helical radius "r," and helical twist, which is opposite the helical twist of tube bundle 34. All of the individual tubes 62, 64 and 66 of tube bundle 60 share a common helical axis 68 and a cylindrical radius 65 that is tangent to the outermost edges of the tubes forming the first tube bundle 60. Helical axis 68 is parallel to helical axis 48 and offset radially by a distance L2. Because the individual tubes of tube bundle 60 have the opposite direction of twist, however, the distance L2 can be less than:

$$L2 < \left[\left(\frac{2(t+d)}{\sqrt{3}}\right)+d\right]$$

where "t" is the spacing between tubes in the bundle and "d" is the outside diameter of the tubes in the bundle. This is because tubes having opposite-twist can nest together without the helixes crossing over. In the illustrative embodiment, the distance L2 is substantially equal to:

$$L2=(t+d)\sqrt{3}$$

where "t" is the spacing between tubes in the bundle and "d" is the outside diameter of the tubes in the bundle. This results in an overlap region "q" between a tube 24 in tube bundle 34 and cylindrical radius 65 of tube bundle 60, and results in a corresponding increase in the packing density of the individual tube bundles.

With additional reference to FIG. 5, in the illustrative embodiment, heat exchanger 10 comprises nine tube bundles attached between bulkhead 16 and bulkhead 26. The nearest vertical row of tube bundles consists of a tube bundle 34*a* consisting of tubes 20*a*, 22*a* and 24*a* all of which have a right-hand helical twist. Immediately adjacent to tube bundle 34*a* is a tube bundle 60*a* consisting of tubes 62*a*, 64*a* and 66*a* all of which have a left-hand helical twist. Immediately adjacent to tube bundle 60*a* is a tube bundle 34*b* consisting of tubes 20*b*, 22*b* and 24*b* all of which have a right-hand helical twist. The three tube bundles are arranged in a linear array in that the helical axes 48*a*, 68*a*, and 48*b* are parallel and in a common plane. As can be seen from FIG. 5, the remainder of the tube bundles are arranged with the helical axes laid out in a series of linear arrays forming a rectangular matrix. In the matrix, each tube bundle is adjacent on all sides to tube bundles having the opposite helical twist. Thus for example, the nearest vertical row in FIG. 5 has bundles that are right-hand, left-hand, right-hand. The middle vertical row has bundles that are left-hand, right-hand, left-hand and the farthest vertical row has bundles that are right-hand, left-hand, right-hand. The ability to closely pack the tube bundles together in linear arrays of any number of tube bundles provides wide flexibility in designing heat exchangers of all shapes and sizes from thin flat rectangular prisms to curved prisms and other shapes as the particular application may require.

Figure 6:
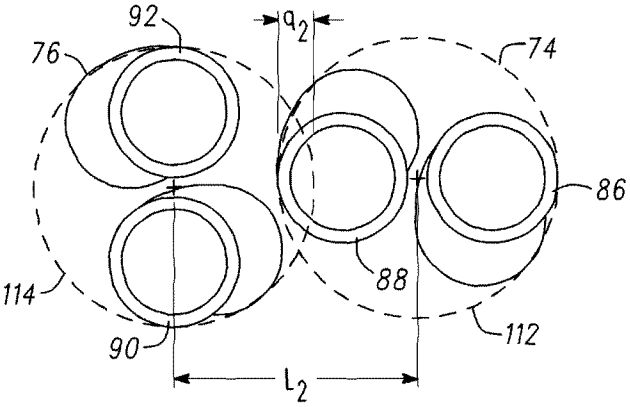
FIG. 6 is an end view of a pair of tube bundles for use in an alternative embodiment of a heat exchanger incorporating features of the present invention.
Figure 8:
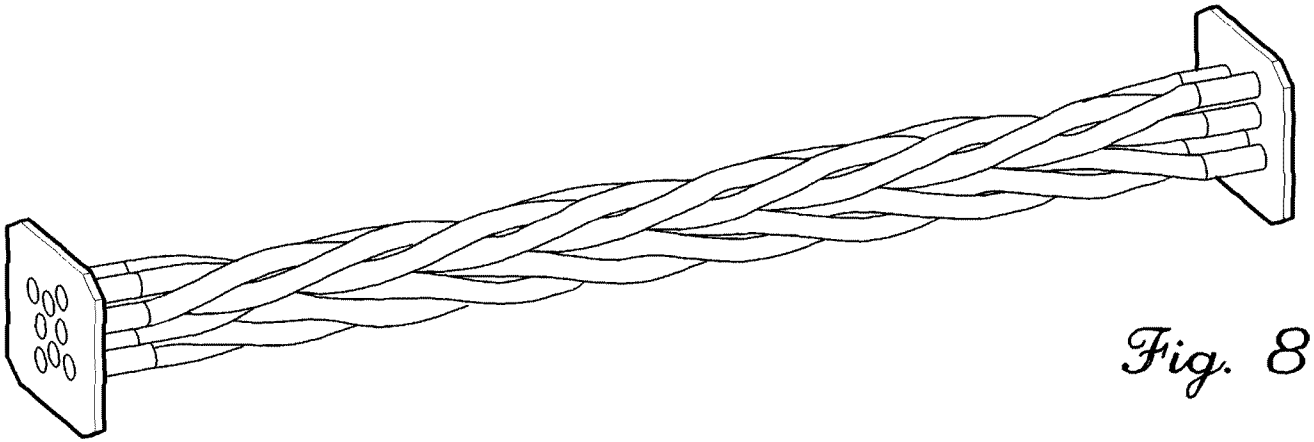
FIG. 8 is a perspective view of a heat exchanger incorporating the tube bundles of FIG. 6 with the shell removed for clarity.
Figure 7:
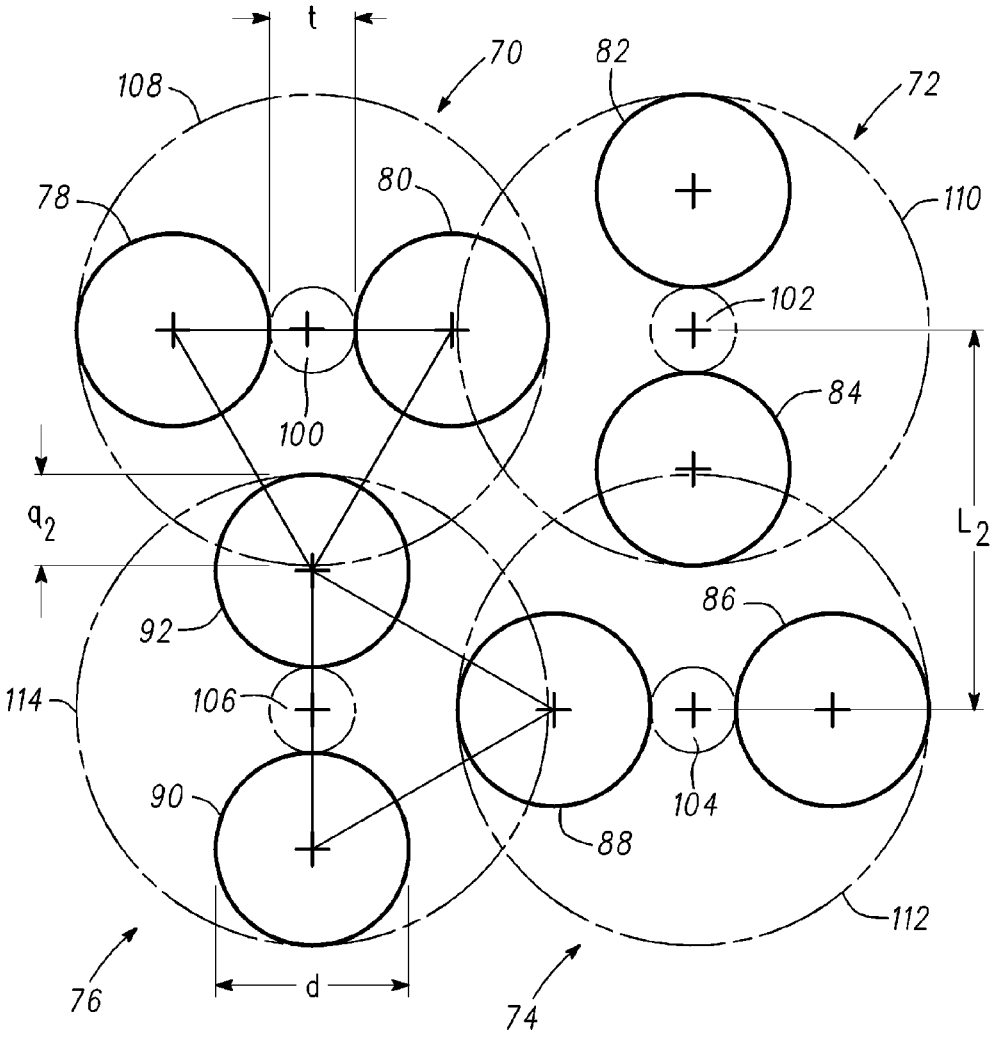
FIG. 7 is a simplified end view of a set of four tube bundles for use in the heat exchanger of FIG. 6.

In an alternative embodiment as shown in FIGS. 6-8, tube bundles 70, 72, 74, and 76 each comprise exactly two tubes, 78, 80, 82, 84, 86, 88, 90 and 92. Each of the individual tubes of tube bundles 70, 72, 74, and 76 tubes has a relatively short straight section (not shown) at the gas inlet end 12 and a relatively short straight section (not shown) at gas outlet end 14. In between the relatively short straight sections, each pair of individual tubes is wound into a helix, each of which has the same helical pitch, helical radius "r," and helical twist direction and share a common helical axis 100, 102, 104, and 106 respectively. The tubes in tube bundles 70 and 74 have the same direction of twist (e.g. right hand) while the tubes in tube bundles 72 and 76 both have a twist direction that is opposite to that of tube bundles 70 and 74 (e.g. tube bundles 72 and 76 both have a left-hand twist). As shown in FIG. 7, this enables the spacing $L_2$ between the axes of adjacent tube bundles (e.g. between axes 102 and 104 of tube bundles 72 and 74) to be less than the sum of a cylindrical radius 110 of tube bundle 72 and a cylindrical radius 112 of tube bundle 74 (the minimum distance that could be achieved with tube bundles having the same direction of twist. (Similarly, as shown in FIG. 6, the spacing $L_2$ between tube bundles 74 and 76 is less than the sum of a cylindrical radius 112 of tube bundle 74 and a cylindrical radius 114 of tube bundle 76). The same relationship holds true for the remaining adjacent tube bundles.

As can be seen from FIG. 8, the remainder of the tube bundles are arranged with the helical axes laid out in a series of linear arrays forming a rectangular matrix. In the matrix, each tube bundle is adjacent on all sides to tube bundles having the opposite helical twist.

In the illustrative embodiment of FIGS. 6-8, the spacing $L_2$ between the axes adjacent tube bundles is defined by the following equation:

$$L_2 = \frac{1+\sqrt{3}}{2}(t+d)$$

Where "t" is the spacing between tubes in the tube bundle and "d" is the outside diameter of the tubes.

With reference to FIG. 7, the overlap region $q_2$ between a tube 92 in tube bundle 76 and cylindrical radius 108 of tube bundle 70 is defined by the following equation:

$$q_2 = \frac{1-\sqrt{3}}{2}t + \frac{3-\sqrt{3}}{2}d$$

Where "t" is the spacing between tubes in the tube bundle and "d" is the outside diameter of the tubes. The same relationship holds true for the remaining tube bundles, e.g. between a tube 88 of tube bundle 74 and a cylindrical radius 114 of tube bundle 76. The packing efficiency, defined as the cross-sectional area of tubing within a rectangle having corners at the helical axes of the four tube bundles is defined by the following equation:

$$E = \frac{(2-\sqrt{3})\pi d^2}{(t+d)^2}$$

From the above equation, for a given tube size, efficiency is maximized when "t"=0 and, therefore the tube overlap for maximum efficiency is:

$$q_2 = \frac{3-\sqrt{3}}{2}d$$

which is approximately 0.634 d. Preferably, therefore, the spacing $q_2$ is between $$\frac{\sqrt{3}-1}{\sqrt{3}}d \le q_2 \le \frac{3-\sqrt{3}}{2}d$$

which is approximately between 0.422 d and 0.634 d.

Although certain illustrative embodiments and methods have been disclosed herein, it will be apparent from the foregoing disclosure to those skilled in the art that variations and modifications of such embodiments and methods may be made without departing from the invention. For example, although in the illustrative embodiment each tube bundle is made from two or three individual tubes, bundles consisting of four tubes or more are considered within the scope of the invention. Additionally, although the tubes forming the tube bundles in the illustrative embodiment are circular in cross section, tubes having non-circular cross sections may be advantageously used in a heat exchanger incorporating features of the present invention and therefore are considered within the scope of the invention. Also, it should be observed that although the helical axis of the tube bundles extend from bulkhead-to-bulkhead, it is not necessary that the tube bundles be continuously helical from bulkhead-to-bulkhead as long as they are helical about a common helical axis over some portion of their length. Accordingly, it is intended that the invention should be limited only to the extent required by the appended claims and the rules and principles of applicable law. Additionally, as used herein, references to direction such as "up" or "down" are intend to be exemplary and are not considered as limiting the invention and, unless otherwise specifically defined, the terms "generally," "substantially," or "approximately" when used with mathematical concepts or measurements mean within ±10 degrees of angle or within 10 percent of the measurement, whichever is greater.

What is claimed is:

1. A heat exchanger for transferring heat between a first fluid and a second fluid comprising:

a first tube bundle comprising a first plurality of tubes adapted to allow the first fluid to flow therethrough, the first plurality of tubes each having an inlet forming a first set of inlets, the first plurality of tubes each having an outlet forming a first set of outlets, the first set of inlets being attached to an inlet support at an inlet end, the first set of outlets being attached to an outlet support at an outlet end, each of the first plurality of tubes following a helical path along a first common helical axis in a twist direction chosen from the group consisting of right-hand twist and left-hand twist, the helical path of each of the first plurality of tubes having substantially the same helical pitch and helical radius;

a second tube bundle comprising a second plurality of tubes adapted to allow the first fluid to flow therethrough, the second plurality of tubes each having an inlet forming a second set of inlets, the second plurality of tubes each having an outlet forming a second set of outlets, the second set of inlets being attached to the inlet support at the inlet end, the second set of outlets being attached to the outlet support at the outlet end, each of the second plurality of tubes following a helical path along a second common helical axis in a twist direction opposite to that of the first tube bundle, the helical path of each of the second plurality of tubes having substantially the same helical pitch and helical radius; and a shell surrounding the first and second tube bundles, the shell having an inlet port and an outlet port for flowing the second fluid through the shell past the first and second tube bundles; wherein the first and second tube bundles each consists of exactly two tubes and wherein the second helical axis is offset from the first helical axis by an amount that is less than sum of a cylindrical radius tangent to the outermost edges of the first tube bundle plus a cylindrical radius tangent to the outermost edges of the second tube bundle and wherein an overlap region between a tube of the first tube bundle and the cylindrical radius tangent to the outermost edges of the second tube bundle is not more than $$\frac{3-\sqrt{3}}{2}(d)$$

where "d" is the outside diameter of the tubes in the bundle.

2. The heat exchanger of claim 1, further comprising:

a third tube bundle consisting of exactly two tubes, each of the third plurality of tubes following a helical path along a third common helical axis, the third helical axis being in a location radially offset from the first common helical axis such that the first helical axis, the second helical axis, and the third helical axis lie in a common plane.

3. The heat exchanger of claim 2, wherein:

the first and third tube bundles have a right-hand twist and the second tube bundle has a left-hand twist.

4. The heat exchanger of claim 2, wherein:

the first and third tube bundles have a left-hand twist and the second tube bundle has a right-hand twist.

5. The heat exchanger of claim 1, further comprising:

a third tube bundle and a fourth tube bundle, each consisting of exactly two tubes, each of the third plurality of tubes following a helical path along a third common helical axis, each of the fourth plurality of tubes following a helical path along a fourth common helical axis, the third and fourth helical axis being located radially offset from the first common helical axis such that the first, second, third and fourth helical axes, form a rectangular array.

6. The heat exchanger of claim 5, wherein:

half of the total number of tube bundles have tubes with a right-hand helical twist and half of the tube bundles have tubes with a left-hand helical twist, wherein the tube bundles are arranged such that each tube bundle having a right-hand helical twist is adjacent only to tube bundles having a left-hand helical twist.

7. The heat exchanger of claim 6, wherein:

each tube bundle having a left-hand helical twist is adjacent only to tube bundles having a right-hand helical twist.

8. The heat exchanger of claim 1, wherein:

the first fluid is exhaust gas from an internal combustion engine.

9. The heat exchanger of claim 8, wherein:

the second fluid is coolant from the cooling system of an internal combustion engine.

* * * * *